US005940999A

United States Patent [19]

Harruff et al.

[11] Patent Number: 5,940,999

[45] Date of Patent: Aug. 24, 1999

[54] ROLL SIGN MODULE UNIT

[75] Inventors: Robert J Harruff, Pewaukee; Philip P Gross, Brookfield, both of Wis.

[73] Assignee: Everbrite, Inc., Greenfield, Wis.

[21] Appl. No.: 09/084,629

[22] Filed: May 26, 1998

[51] Int. Cl.[6] ..... G09F 11/18

[52] U.S. Cl. ..... 40/471; 40/518; 242/538.1

[58] Field of Search ..... 40/471, 518, 519, 40/522, 523; 242/538.1, 538.2, 538.3

[56] References Cited

U.S. PATENT DOCUMENTS

| | | | |
|---|---|---|---|
| 734,982 | 7/1903 | Smith . | |
| 1,042,519 | 10/1912 | Wotherspoon | 40/471 X |
| 1,114,223 | 10/1914 | Brown | 40/471 |
| 1,902,884 | 3/1933 | Wagner . | |
| 2,182,084 | 12/1939 | Keilwagen | 40/518 |
| 3,255,541 | 6/1966 | Bettcher . | |
| 3,293,782 | 12/1966 | Drexler | 40/471 |
| 4,110,925 | 9/1978 | Strand et al. . | |
| 4,773,176 | 9/1988 | Grehan . | |
| 5,003,717 | 4/1991 | Trame et al. | 40/471 X |
| 5,488,791 | 2/1996 | Boni | 40/471 X |
| 5,673,504 | 10/1997 | Brown | 40/518 |

*Primary Examiner*—Brian K. Green
*Attorney, Agent, or Firm*—Kyan Kromholz & Manion

[57] ABSTRACT

First and second rolls arranged with their axes parallel to each other and spaced from each other between said side frame members for being driven rotationally to wind an information bearing web on one roll while the web is unwinding from the other roll. The rolls are journaled for rotation at their opposite ends on stub axles that project in cantilever fashion from opposite side members of the frame. Each roll has a gear fastened to a corresponding end coaxially with the roll. A drive shaft extends transversely to the axes of both rolls. A first pinion is positioned on the drive shaft for meshing with the gear on the first roll and is free to turn on the drive shaft. A second pinion is fastened to the drive shaft and meshes with the gear on the second roll. A spur gear is fastened to the drive shaft between the pinions. A tube spans between the spur gear and first turnable pinion for supporting a helical spring that has one end fastened to the spur gear and its other end fastened to the first pinion so when the drive shaft is rotated by hand or by a reversible motor the first rolls are driven elastically through the agency of the helical spring.

10 Claims, 3 Drawing Sheets

4
35
38
25
39
15
25
69
3
49
3
22
46
17
67
16
47
11
48
59
19
12
29
32
10
28
30
33
34
83
37
35
73
22
69
50
52
39
46
36
21
20
21
67
41
40
4

FIG. 4
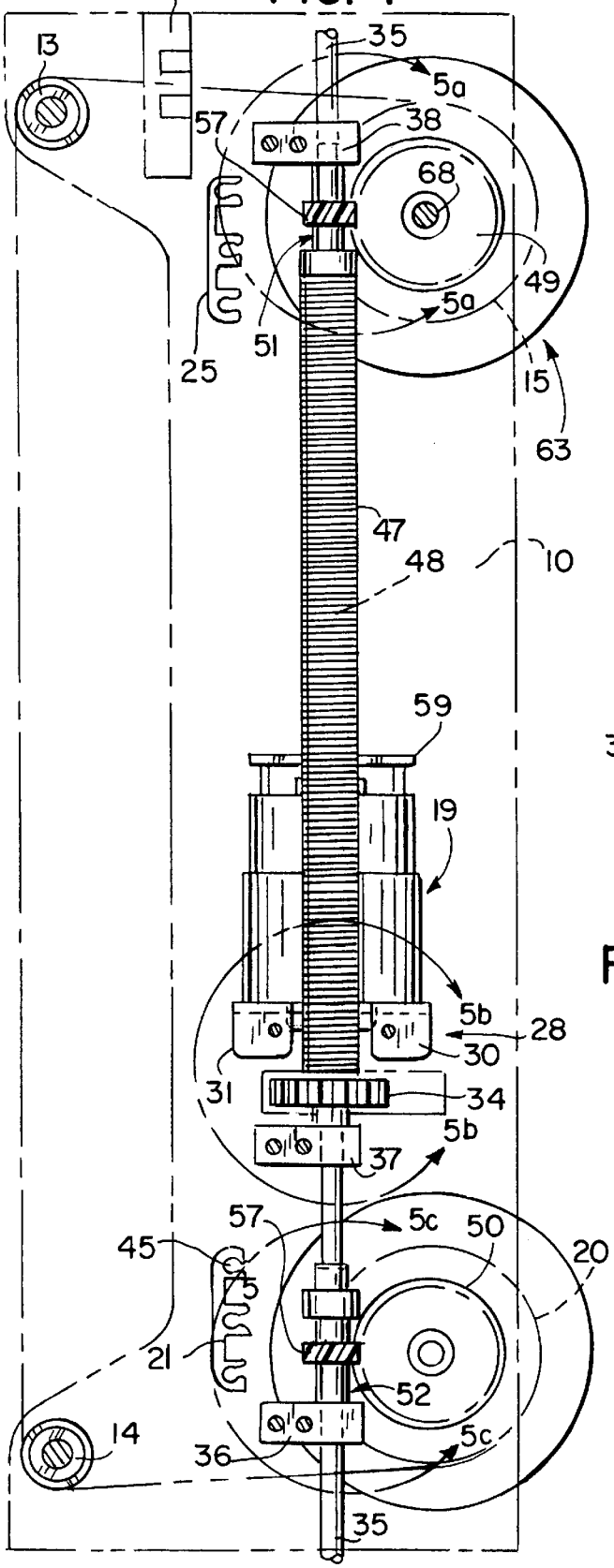
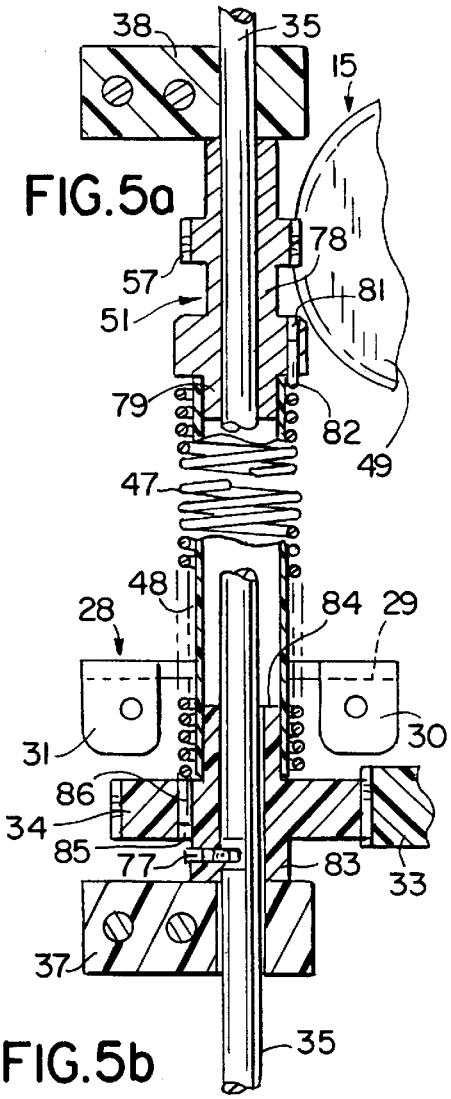
FIG.5a
FIG.5b
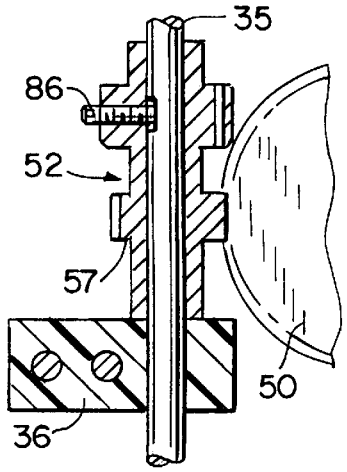
FIG. 5c

ROLL SIGN MODULE UNIT

BACKGROUND OF THE INVENTION

The invention disclosed herein pertains to a scroll sign module comprised of two rolls that are mounted between laterally spaced apart side walls of a frame for rotating bidirectionally about parallel axes to wind an information bearing web onto one roll as the web unwinds from the other roll such that information can be read from the web segment that extends from one roll to the other.

Roll sign modules have various applications. A popular application is to display the price of vehicle fuel where several modules are arranged in juxtaposition to compose the price and are mounted on a pole at a great height adjacent a highway for being visualized by vehicle drivers at a great distance. A typical roll sign module has one or two electric motors operatively coupled in driving relation with the two spaced apart rolls by means of a suitable mechanism including gears, chains, sprockets, toothed belts and pulleys. Typically, at least one of the rolls in a pair is coupled to a driving source inelastically or positively and the other roll in the pair is a so-called web tensioning roll that is driven rotationally through the agency of an elastic device such as a helical or a spiral spring. The spring that is coupled to the tension roll provides for maintaining a substantially constant tension in the web even though the diameter of one roll increases and the other decreases as the web is wound and unwound from one roll to another.

U.S. Pat. No. 734,982, which was granted to Smith on Jul. 28, 1903, discloses a scroll sign module wherein a tension roll is journaled for rotation on a rotationally driven shaft. A spiral spring is installed in a cylindrical recess in the end of the tension roll concentrically to the roll driving shaft that extends through the recess. The inside end of the spiral spring is attached to the rotationally driven shaft and the outside end of the spring is attached to the tension roll so that when the shaft rotates the tension roll is driven elastically by way of the spiral spring that couples the shaft to the roll. The shafts for the tension roll and the other cooperating roll are provided with sprockets for being driven with a motor and a closed loop chain. In this patent, the drive mechanism includes a lead screw operated with a chain and gear system to switch the take-up roll to becoming the unwind roll for the web and, vice versa, when the end of the web is reached.

Among the problems of driving rolls with chains and sprockets is that these components must be lubricated regularly to maintain good module operation and inhibit corrosion. Applying lubricant to the components of a sign that is mounted on a tall structure, as is usually the case, is an inconvenient and unpleasant task. Chains also have the undesirable property of becoming less flexible when the ambient temperature drops to below 0° on the Fahrenheit scale, which is not uncommon during the winter in the northern states. A stiff chain requires a greater force to bend it around the sprockets which can result in overloading the small module operating motor. A loose chain may come off the sprocket and an excessively tight chain may impose a greater load on the motor that drives a module.

U.S. Pat. No. 4,773,176, which was granted to Grehan on Sep. 27, 1988, also drives a tension roll in a sign module through the agency of a spiral spring. In this design a toothed pulley fits on the end of the tension roll shaft. The pulley has a large axial counter bore in which the spiral spring is positioned concentrically to the shaft with the inside end of the spiral spring attached to the shaft and the outside end attached to the toothed pulley. Driving the pulley rotationally causes an elastic or yieldable torsional force to be applied to the shaft for the roll so the shaft and roll can change their angular relationship to compensate for the overall change in the diameter of the roll and the web thereon that results from the amount of web on one roll decreasing while it is increasing on the other roll.

One problem with driving through the agency of a toothed belt is that thermal expansion differs substantially from the thermal expansion of the metal frame that supports the components of the module. Hence, at low ambient temperatures, the toothed belt becomes too loose and at higher temperatures the belt may become too tight. An excessively tight belt can impose a large radial load on the motor and the bearing for the roll and a loose belt can unmesh from the toothed pulleys. Moreover, in cold weather toothed belts become stiffer and require increased force to bend around the pulleys. This also imposes a greater load on the motor which could make the module inoperative at some temperatures.

U.S. Pat. No. 3,255,541, which was granted to Bettcher on Jun. 14, 1966, discloses another version of a scroll module. In this patent a web tension maintaining roll has stub-axles extending axially inwardly for a short distance at opposite ends of the roll. The stub-axle at the driven end of the roll extends coaxially from a pinion gear that is driven by a motor driven gear chain. A helical spring is mounted concentrically to the stub-axle inside of the tension roll. One end of the helical spring is attached to the power driven stub-axle and the other end of the spring is attached to the roll to thereby provide an elastic connection between the power driven stub-axle and the roll to compensate for the changing overall diameter of the web on the roll as the web is transferred between the parallel arranged tension and cooperating rolls. The Bettcher module would have the problems incident to driving rolls through gear, sprocket and chain systems as has been explained.

U.S. Pat. No. 5,673,504, which was granted to Brown on Oct. 7, 1997, also discloses a module wherein a tension roll is driven elastically through the agency of a spiral spring that is positioned inside of the tension roll as in the previously mentioned Smith patent. In this patented design a module is comprised of the usual laterally spaced apart side frame members between which the two parallel web winding and unwinding rolls are positioned. To provide for rotation of the tension roll, bearing members are fixedly mounted in each of the spaced apart frame members in coaxial relationship. Each bearing member has a central bore constituting an inside bearing or bushing for an axle and has a smooth concentric periphery constituting an outside bearing on which an end cap for the roll can rotate. The end cap has an annular recess for containing a spiral spring that is concentric to the rotational axis of the roll. A pulley for driving the roll rotationally with a belt is positioned outside of the frame member and a stub-axle that is unitary with the pulley extends axially from it for being journaled in the bushing and for extending into the spring recess in the end cap to provide for connecting the inside end of the spiral spring to the rotationally driven stub-axle and the outside end of the spiral spring to the end cap. Since the end cap is latched to the roll, when the stub-axle is driven rotationally by means of the belt and pulley, a torsional force is applied to the end cap through the spring for rotating the tension roll.

Additional patent references that disclose driving a tension roll in a module through the agency of a helical spring are U.S. Pat. No. 4,110,925 which was granted to Strand et al. on Sep. 5, 1978 and U.S. Pat. No. 1,902,884 which was granted to Wagner on Mar. 28, 1933.

SUMMARY OF THE INVENTION

The new sign module disclosed herein uses some parts that have been used in pre-existing module designs including laterally spaced apart frame members having a pair of web winding and unwinding rolls arranged between them with their axes of rotation parallel to each other. A first roll is designated a tension roll driven through a spring and the other or second is directly and positively driven. According to the invention, a small electric motor is mounted adjacent one of the side frame members inside of the module. A main drive shaft extends perpendicular to the axes of the first and second rolls. A gear on the shaft of the small reversible electric motor drives a gear on a long drive shaft that crosses the axes of both rolls.

In the preferred embodiment, the first or tension roll is journaled for rotation on standoffs, comprising stationary shafts, that project towards each other coaxially from each of the side frame members. A gear on one end of the tension roll is engaged with a driving gear that is free to rotate on the drive shaft. The tension roll, according to the invention, is driven elastically by means of a helical spring that is arranged concentric to the motor driven drive shaft. One end of the elongated helical spring is fixed to a gear that is fastened to the motor driven drive shaft. The other end of the helical spring is fastened to the freely turning gear on the drive shaft that is meshed with the gear on the tension roll. With this arrangement, when the drive shaft is rotated by the motor, the torsional force for driving the tension roll is transmitted through the spring to the gear on the drive shaft which is meshed with the gear on the roll. Thus, the tension roll can change its angle of rotation or phase angle relative to the positively or inelastically driven second roll to compensate for the changing diameter of the coil of web as the web unwinds from one roll and winds onto the other roll.

There is a tube extending concentrically to the main drive shaft of the module and the helical spring through which the tension roll is driven elastically is supported by the tube.

The design provides for making modules of large and small sizes with essentially the same drive components for each size although lengthening or shortening of the main drive shaft and, possibly, the length of the side frame members to which the rolls are mounted for rotation may be necessary.

An important feature of the new module is that it is immune from the effects of ambient temperature changes because of its all metallic structural components and the ability of the gears to remain meshed even if there is some dimensional change in the structure.

A further feature of the new module design is that the moving parts including the rolls for the web and the gears and motor driven drive shafts are all within the confines of two laterally spaced apart side frame members. Hence, the modules can be arranged close to each other to yield the beneficial aesthetic effect of the characters on their respective webs being properly close to each other rather than stretched out by a greater distance than the eye intuitively desires to perceive.

Another unique feature of the design is that it can be provided with a flexible shaft that is coupled to the main drive shaft to provide for manual operation of the module if desired.

How the foregoing and other features and objectives of the invention are implemented and achieved will appear in the more detailed description of a preferred embodiment of the invention which will now be set forth in reference to the accompanying drawings.

DESCRIPTION OF THE DRAWINGS

FIG. 4 is a side elevational view of the sign module taken on a line corresponding to the line 4—4 in FIG. 2; and FIGS. 5*a,* 5*b,* and 5*c* are enlargements of the components embraced in the correspondingly labeled sight windows 5*a,* 5*b,* and 5*c* in FIG. 4.

DESCRIPTION OF A PREFERRED EMBODIMENT

Figure 1:
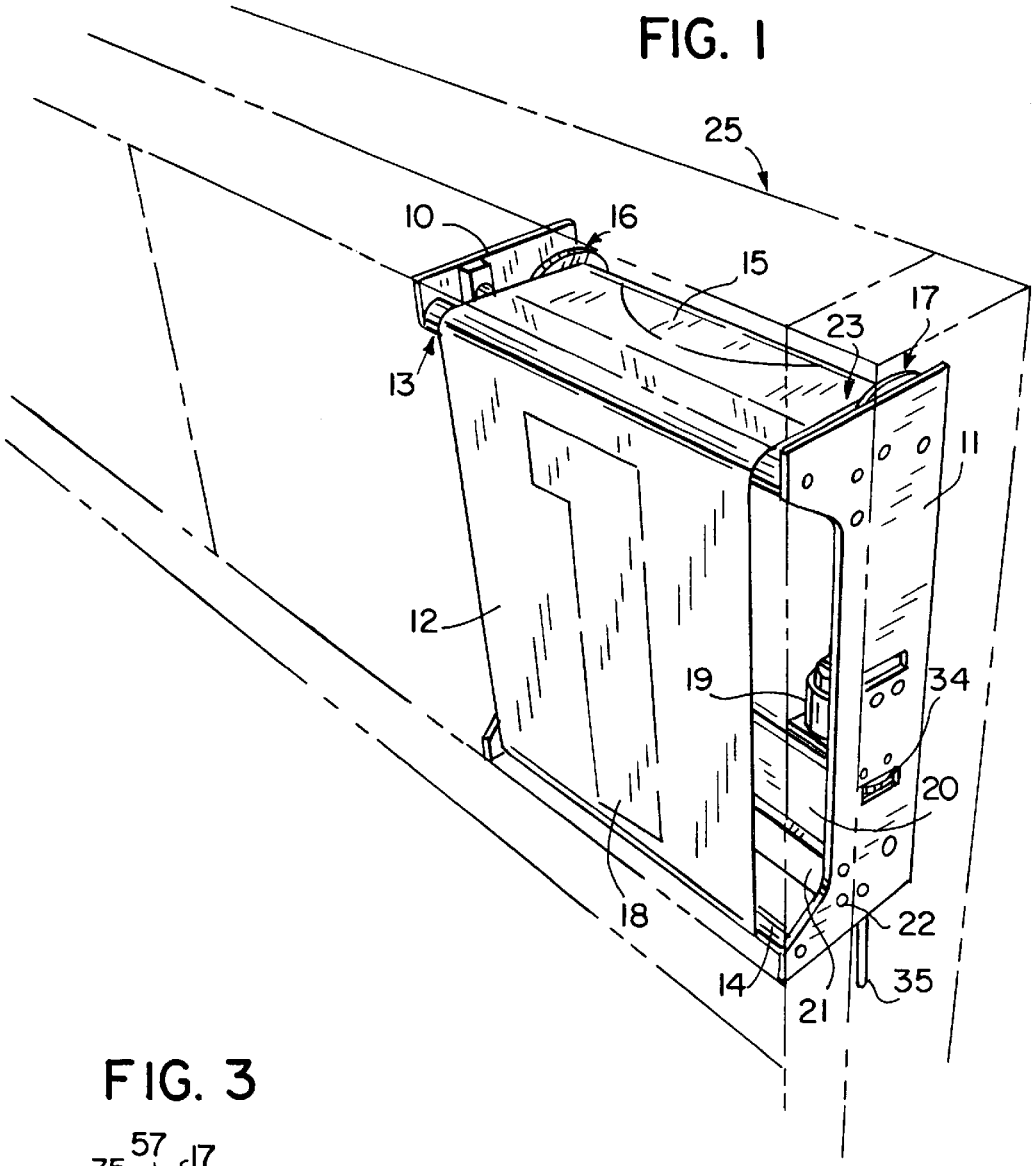
FIG. 1 is a front top perspective view of the new sign module showing its side frame members, its partially exposed tension roll, a reversible electric motor and an indicia or information carrying web.

FIG. 1 shows one of the new sign modules in solid lines mounted within a housing 25 for holding a plurality of such modules in juxtaposition where the housing is represented in phantom lines. The module is comprised of side frame members 10 and 11 which are preferably composed of aluminum. An information bearing plastic web 12 is being held in tension between idler rolls 13 and 14. A part of the first or tension roll 15 is visible. The end caps 16 and 17 for the tension roll 15 are also visible in FIG. 1. Web 12 is presently displaying information in the form of the numeral 1 which is marked 18. Usually, the numerals and the background surrounding the information are translucent to provide for accentuating the visibility of the information when the web is backlighted. Part of the motor 19 for driving the web winding and unwinding rolls of the module is also visible in FIG. 1. The second or inelastically driven roll is marked 20. One of two cross bars 21 that tie the side wall members 10 and 11 together to form a rigid frame is designated by the numeral 21 and is visible in FIG. 1. The side walls are fastened to the ends of the cross bars by means of self tapping screws such as the one 22 of two whose heads are visible in FIG. 1. The sidewall members 10 and 11 provide surfaces for the ends of the cross bars 21 and 25 to seat so that a typical fastening screw 22 passes through the side wall 11 and then screws into the end of the cross bar 21. The cross sectional configuration of the cross bar 21 and 25 can be seen in FIG. 4.

It will be understood that a module such as is depicted in solid lines in FIG. 1 is one of a plurality of modules that are to be arranged in juxtaposition and mounted in a housing 25 which is represented by the phantom lines associated with the module.

Figure 2:
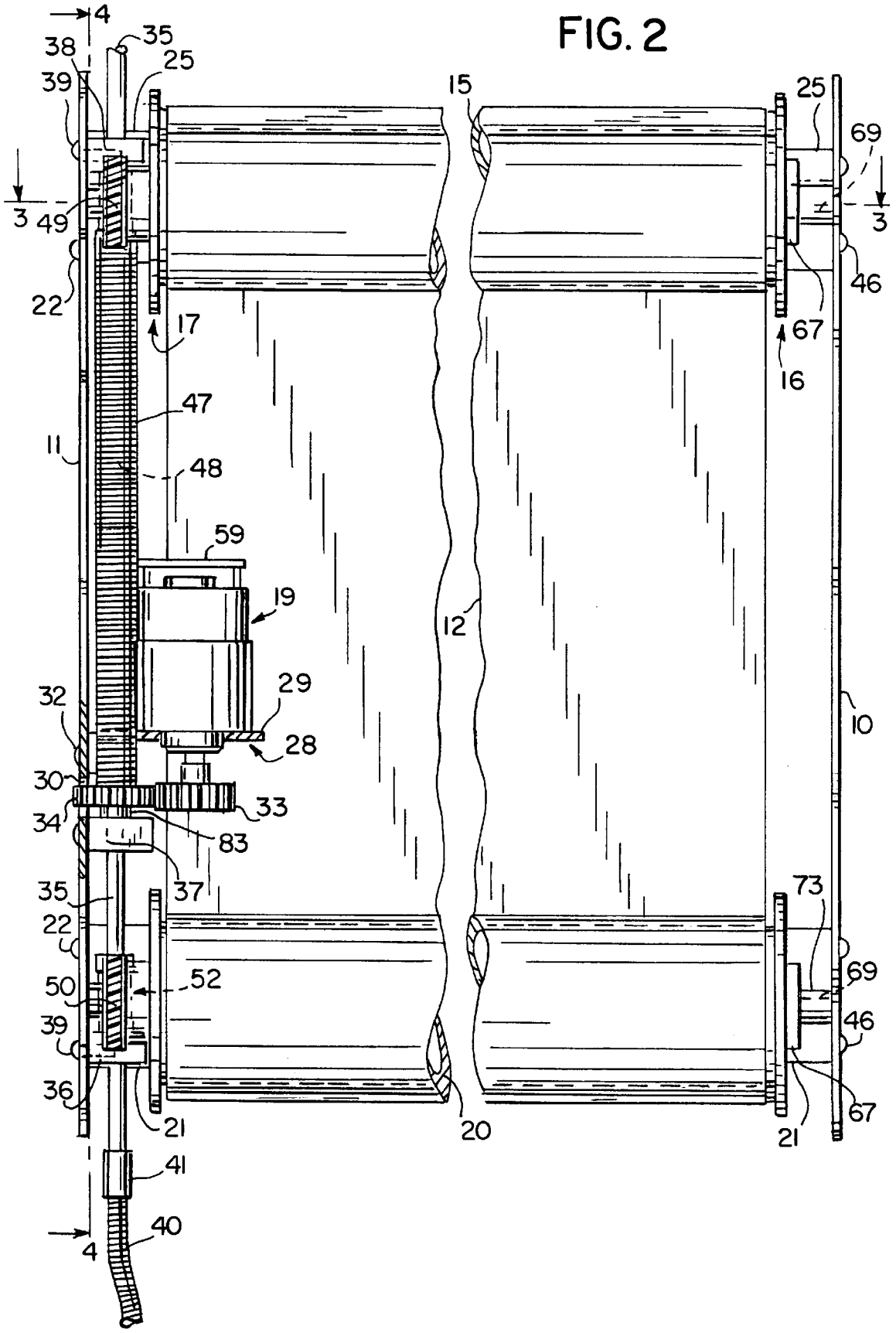
FIG. 2 is a rear elevational view of the sign module showing the upper tension roll and the lower second roll on which the information bearing web winds and unwinds, a motor driven drive shaft, the gears on the drive shaft and the rolls, a long helical tube supported spring, and the flexible manually operable module main drive shaft attachments.

The rear elevational view of the module in FIG. 2 shows the reversible electric motor 19 for driving the web winding and unwinding rolls 15 and 20 rotationally. The motor is mounted on an L-shaped bracket that is indicated generally by the numeral 28. The L-shaped bracket 28 is comprised of a planar portion 29 that is bent 90° to form feet 30 and 31 which are visible in FIG. 4. As shown in FIG. 2, a gear 33 is fastened to the shaft of motor 19. The teeth of gear 33 are meshed with a driven gear 34 that is fastened to a long main drive shaft 35 which is involved in driving the first or tension roll 15 and the second roll 20 concurrently when the motor is running in either direction of rotation. Main drive shaft 35 is journaled in three bearing blocks 36, 37, and 38 which are fastened to frame side wall 11 by means of pairs of screws such as the screw 39 whose head is visible in FIG. 2. Main drive shaft 35 is driven by way of motor 19 customarily but it can be driven in either direction of rotation manually too in accordance with the present invention. To provide for manual operation of the drive shaft 35, a flexible cable 40 is connected to one or both opposite ends of shaft 35 by means of a coupling 41 which is illustrated as being connected to the lower end of the main drive shaft 35 in FIG. 2. For some sign module installations, such as where the modules are easily reached from ground level, the cable 40 can be dispensed with and a suitable knob, not shown, can be substituted for coupling 41 to facilitate turning shaft 35 manually. In most if not all prior designs, the information web 12 can only be translated by grasping a chain or belt. This sacrifices the convenience of somewhat remote manual operation.

FIG. 2 shows the opposite ends of the lower tie cross member 21 and upper cross member 25 fitted between the side plate frame members 10 and 11. Typical side plate 10 can be configured as demonstrated by its phantom line outline in FIG. 4. The cross members 21 and 25 whose end views are visible in FIG. 4 are preferably aluminum extrusions. In FIG. 4 one may see that a typical cross member 21 has three longitudinally slotted circular channels such as the channel marked 45. The channels are for securing the side frame members 10 and 11 to the ends of the cross tie members 21 and 25 by way of self-tapping screws, such as the screws 46, whose heads are visible in the lower right region of FIG. 2.

Note in FIG. 2 that a majority of the length of the main drive shaft 35 is surrounded concentrically by a helical spring 47. Actually the spring is on a support tube 48 that is concentric to drive shaft 35 as can be perceived most clearly by inspecting FIG. 5*a*. Note also in FIG. 2 that the tension roll 15 has a spiral toothed gear 49 coaxially coupled to it and that the second roll 20 has a spiral toothed gear 50 coupled to it. Shown in dashed lines under gear 49 is a spiral toothed pinion gear element, generally designated by the numeral 51. Gear element 51 is positioned on the main drive shaft 35 and can turn on the shaft and includes a spiral toothed pinion gear 57 which can be visualized in the upper part of FIG. 4, for example. The spiral teeth of pinion 57 are meshed with the spiral teeth of the first or tension roll drive gear 49 which is connected to the tension roll. The helical spring 47 which is concentric to main drive shaft 35 has one of its ends attached to gear 34, which is a spur gear preferably, and its opposite end attached to pinion gear element 51 so that the spring becomes a torque transmission element between gear 34 and pinion 57 for driving the first or tension roll 15 in either direction of rotation. Thus, when the main drive shaft 35 turns in one direction to move web 12 in one direction, spring 47 transmits its torque to pinion gear element 51 and develops a force for keeping the web taut between rolls 15 and 20. The reason for the spring drive is that the roll diameter is increasing as the web is wound on it so the spring provides the elasticity which compensates for the roll become larger in diameter as the web winds on it. If the elasticity in the drive provided by the spring were absent, the tension on the web could become great enough to break the web or stall the motor 19. When the main drive shaft turns in a direction to unwind web from the tension roll 15 and wind web onto second roll 20, the stored torsional energy in spring 47 is available for keeping the web section between rolls 15 and 20 taut.

Second roll 20 is driven in either direction positively, that is, inelastically by reason of its pinion element 52 being fastened directly to main drive shaft 35 which turns when spur gear 34 turns because the spur gear is fastened to the drive shaft 35 with a set screw 77.

Figure 3:
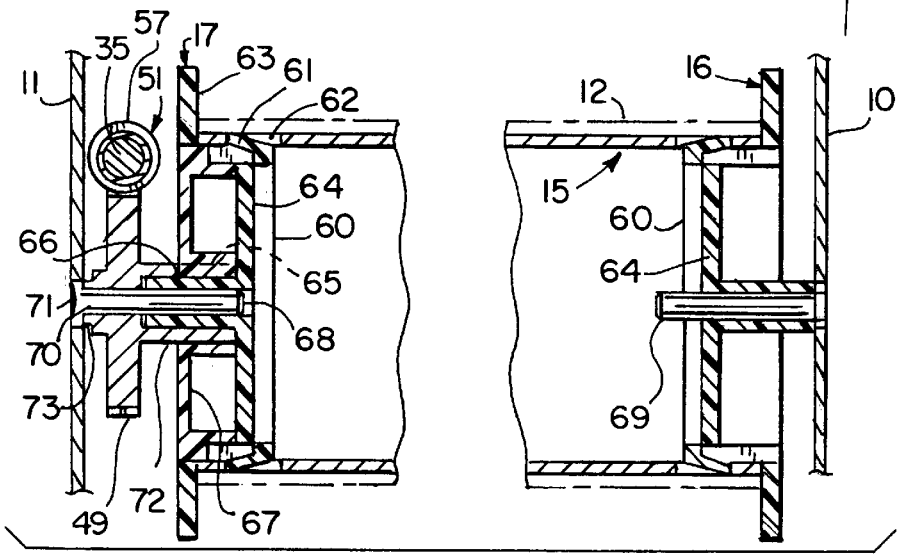
FIG. 3 is a section taken on a line corresponding to the line 3—3 in FIG. 2.

Attention is invited to FIG. 3 for describing the structure of the web winding and unwinding rolls. Tension roll 15 is used as an example. Rolls 15 and 20 are basically the same. Typical roll 15 in FIG. 3 is disposed between side walls 10 and 11 which comprise the frame of the roll sign module. Roll 15 may be a thin metallic cylinder or it can be composed of a suitable rigid plastic material. A portion of a coil of web 12 on roll 15 is represented in phantom lines. Roll 15 is provided with the previously mentioned end caps 16 and 17. In FIG. 3, one may see that end cap 16 simply provides a way of journaling the undriven end of the roll on a standoff shaft 69. However, end cap 17 at the left end of roll 15 in FIG. 3 is latched to the roll as will be elaborated. Considering end cap 17, it is a one piece element comprised of a cylindrical body 60 whose periphery is staked out at least two places to form elastic or flexible tapered flexible lugs 61. As is evident from inspection, when end cap cylinder 60 is being pressed into the roll cylinder 15, lugs 61 flex radially inwardly at first and when they finally reach suitable slots 62 in the roll 15, they flex outwardly to lock the end cap cylinder 60 into the roll so when the end cap is driven rotationally roll 15 rotates. End cap cylinder 60 and the circular web retaining and aligning disk 63 of the end cap are unitary with each other and with a recess defining wall 64.

As shown in FIG. 3, typical roll 15 is journaled for rotation on commercially available standoff shafts 68 and 69 through end caps 16 and 17. These shafts have hexagon shaped heads 70. They are installed in an undersized round hold 71 that is drilled in typical frame side wall 11. By pressing the hexagon head into the round hole to cause cold flow of the side wall material the hole assumes a hexagon shape that conforms to the head. This holds the shaft very rigidly for it to extend in cantilever fashion from the frame wall 11.

FIG. 3 shows a spiral toothed driven gear 49 journaled on shaft 68. Gear 49 has an integral spacer collar 72 on one side and another integral spacer ring 73 on the other side that acts to keep the gear properly positioned. Gear 49 is connected in driving relation with the cylindrical member 67 in the end cap 17 by means of key 65 on member 67 and groove 66 on collar 72.

The driven end of the roll assembly in FIG. 3 just discussed is similar to the assembly at the opposite end of the roll which is journaled on standoff or shaft 69. The standoff has the characteristics of coaxial shaft 68 and is, on the other hand, anchored with its hexagon head in sidewall frame member 10. End cap 16 at the right end of the roll in FIG. 3 is the same as end cap 17 at the left end.

In FIG. 3 the teeth 57 of the spiral toothed drive pinion element 51 for the left end of the roll in FIG. 3 are shown meshed with the driven spiral toothed gear 49 which is coupled to the roll. The driven gear 50 that is coaxial with the second roll 20 is shown in FIG. 2 and other figures as being arranged for being driven by its associated pinion gear element 52. The pinion element and the gears for both rolls 15 and 20 are identical, as shown and the end caps and other elements in the first or tension roll 15 and the second roll 20 are identical.

The concept of having the helical web tension compensating spring 47 concentric to the main drive shaft 32 is important for several reasons and is advantageous over having a spring inside of the roll according to common prior practice so the helical spring applied, in accordance with the invention is accessible for easy assembly, maintenance, easy operational status checks and allows for using springs of different sizes and different spring constants for roll sign modules of different heights and sizes while still using most of the parts without making any changes in them.

The details of the elements for elastic or yieldable driving of the first or web tension roll 15 and the second roll 20 will now be discussed in reference to FIGS. 4, 5*a*, 5*b*, and 5*c*. The circled area within the boundaries 5*a*—5*a* in FIG. 4 is depicted enlarged and mostly in section in FIG. 5*a*. In this figure one may see that the drive pinion element 51 is comprised of a body 78 which includes the helically toothed drive pinion 57 for meshing with the gear 49 that is fixed to the first roll 15. The body of pinion element 51 may be composed of a metal such as bronze and so may the gear 49 but these members could also be replaced by a good lubricity plastic material such as acetal. The gear element 51 has an integral short cylindrical axial extension 79. One end of support tube 48 for spring 47 is fitted loosely on extension 79. The gear element 51 has a hole 81 into which the axially extending end 82 of the spring is fitted. Thus, when the spring is twisted about its axis by rotation of main drive shaft 35 it can drive the pinion element rotationally and when the pinion element is driven in an opposite direction, it can give up the torsional force developed in it previously when it was being twisted.

The area circled within the boundaries 5*b*—5*b* in FIG. 4 is depicted mostly in section in enlarged FIG. 5*b*. FIG. 5*b* shows that straight toothed gear 34, which is driven by gear 33 on motor 19, is fitted for turning with drive shaft 35. This gear is unitary with a spacer collar 83 which butts against bearing block 37 to keep the gear properly positioned. Gear 34 has an axial extension 84 on which an end portion of the spring support tube 48 is loosely fitted. A hole 85 in the gear 34 receives the axial extending end 86 of spring 47 so that whenever the gear 34, which is fastened to shaft 35, is driven rotationally in one direction it winds the spring tighter to store energy and when the gear returns oppositely the stored energy in the spring continues to act on the gear 49 to keep the web taut.

The elements encompassed by the partial circle 5*c*—5*c* in FIG. 4 are enlarged and depicted mostly in section in enlarged FIG. 5*c*. Here one may see that the roll driving pinion element 52 is identical to the pinion 51 and they both have spiral toothed pinions integrated with them. However, there is a set screw 86 in the threaded hole for clamping element 52 to drive shaft 35 which is necessary for achieving positive or inelastic driving of second roll 20.

The edges of the web 12 may bear code indicia, not visible, for various reasons among which are to provide for remote readout and determination of which indicia is positioned centrally between rolls of the module for visualization. A suitable system for remote control of web position is described in U.S. Pat. No. 5,003,717 which is assigned to the assignee of the invention described herein. The upper region of FIG. 4 shows a photodetector mounting block 58 through which the edge of the web passes for the detector elements not visible, to respond to passing of the code information on the edge of the web by producing electric signals that are indicative of the web position. Some of the electronics involved in controlling and detecting web position and involved in control of motor 19 are mounted on a printed circuit board 59 which is supported on motor 19 as can be seen particularly well in FIG. 4.

We claim:

1. A sign module having a web for exhibiting information, comprising:

a frame including first and second laterally spaced apart frame members having insides facing toward each other and outsides facing away from each other, first and second cylindrical rolls arranged between said frame members in spaced apart relationship with their axes parallel to each other for one roll to wind and the other roll to unwind the web when the rolls are rotated together, gears coupled coaxially to the first and second rolls, respectively for driving the rolls rotationally when the gears are driven rotationally, an elongated drive shaft supported for rotating about an axis that is transverse to the axes of the rolls, a first pinion on said drive shaft and meshed with the gear coupled coaxially to the first roll, the first pinion being free to turn on the drive shaft, a helical spring surrounding the drive shaft, the spring having one end and an opposite end, the one end being coupled to the drive shaft and the opposite end being coupled to the first pinion to provide an elastic connection between the drive shaft and the first roll, and, a cylindrical element having one end and an opposite end, the one end being supported on the first pinion and the opposite end being supported on said gear element, said cylindrical element being concentric to said drive shaft and said helical spring surrounding said cylindrical element and being supported thereon.

2. A sign module according to claim 1 including a module operating member connected to said drive shaft for being grasped manually to turn the shaft and the rolls.

3. A sign module according to claim 2 wherein said module operating member is a knob fastened to the drive shaft for being grasped manually.

4. A sign module according to claim 2 wherein said module operating member is a flexible element fastened to the drive shaft for being grasped manually.

5. A sign module according to claim 1 wherein an element is interposed between said drive shaft and the spring and the element is fastened to the drive shaft and said one end of the spring is coupled to said element.

6. A sign module according to claim 5 wherein said element is a gear.

7. A sign module according to claim 1 wherein a first spur gear is fastened to said drive shaft and said one end of the spring is connected to said first spur gear to effect said coupling of said spring to the drive shaft, a reversible electric motor is mounted to said frame, and a second spur gear is fastened to the shaft of the motor and is meshed with the first spur gear.

8. A sign module according to claim 1 wherein the gears coupled to said rolls, respectively, are spiral toothed gears and the pinions are spiral tooth pinions.

9. A sign module according to claim 1 wherein a gear element is fastened to the drive shaft and said one end of said spring is fastened to said gear element to effect said coupling of the spring to the drive shaft.

10. A sign module according to claim 1 wherein:

stub axles extend toward each other coaxially from said frame members for supporting said first roll for rotation, said first roll having end caps at axially opposite ends, the end caps being engaged with the roll, a coupling member journaled for rotation on a first one of said stub axles and drivingly engaged with an end cap, said first pinion that is meshed with the gear for the first roll being journaled for rotation on said first axle and being connected to said coupling member.

* * * * *

UNITED STATES PATENT AND TRADEMARK OFFICE

CERTIFICATE OF CORRECTION

PATENT NO. : 5,940,999

DATED : August 24, 1999

INVENTOR(S) : Robert J. Harruff et al.

It is certified that error appears in the above-identified patent and that said Letters Patent is hereby corrected as shown below:

Column 8, Line 17 After shaft" insert --- by a gear element ---

Column 8, Line 50 Before "gear" delete "a" and substitute --- said ---

Signed and Sealed this

Ninth Day of May, 2000

*Attest:*

Q. TODD DICKINSON

*Attesting Officer*

*Director of Patents and Trademarks*